US010487772B2

(12) United States Patent
Funahashi et al.

(10) Patent No.: US 10,487,772 B2
(45) Date of Patent: Nov. 26, 2019

(54) PISTON FOR INTERNAL COMBUSTION ENGINE, AND PRODUCTION METHOD AND PRODUCTION DEVICE FOR PISTON FOR INTERNAL COMBUSTION ENGINE

(71) Applicant: HITACHI AUTOMOTIVE SYSTEMS, LTD., Hitachinaka-shi, Ibaraki (JP)

(72) Inventors: Toshiyuki Funahashi, Zama (JP); Kazuto Kawamoto, Yamato (JP); Minoru Yamauchi, Machida (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 15/531,863

(22) PCT Filed: Oct. 14, 2015

(86) PCT No.: PCT/JP2015/078980
§ 371 (c)(1),
(2) Date: May 31, 2017

(87) PCT Pub. No.: WO2016/088455
PCT Pub. Date: Jun. 9, 2016

(65) Prior Publication Data

US 2017/0268456 A1 Sep. 21, 2017

(30) Foreign Application Priority Data

Dec. 2, 2014 (JP) ..... 2014-243619

(51) Int. Cl.
*F02F 3/00* (2006.01)
*B22C 9/06* (2006.01)
(Continued)

(52) U.S. Cl.
CPC ..... *F02F 3/0076* (2013.01); *B22C 9/06* (2013.01); *B22C 9/062* (2013.01); *B22C 9/103* (2013.01);
(Continued)

(58) Field of Classification Search
CPC .... F02F 3/16; F02F 3/0076; F02F 3/00; F02F 3/10
See application file for complete search history.

(56) References Cited

U.S. PATENT DOCUMENTS 1,341,478 A * 5/1920 Platt ..... F02B 9/10 123/193.5
1,542,209 A * 6/1925 Bergeron ..... F16J 1/18 403/147
(Continued)

FOREIGN PATENT DOCUMENTS

GB 0 493 191 A 10/1938
JP 52-145612 A 12/1977
(Continued)

*Primary Examiner* — Long T Tran
(74) *Attorney, Agent, or Firm* — Foley & Lardner LLP

(57) ABSTRACT

Piston has crown portion 2 having crown surface 2*a* defining combustion chamber, thrust-side and anti-thrust-side skirt portions 3*a*, 3*b* formed integrally with crown portion and sliding on cylinder wall surface, a pair of apron portions 4*a*, 4*a* joined to skirt portions in circumferential direction, recessed portion 6 formed on back surface that is opposite side to crown surface and extending between skirt portions along substantially longitudinal direction, and a plurality of protrusions 7 formed integrally with bottom surface of recessed portion and extending along arrangement direction of skirt portions. At least one end edge in longitudinal direction of protrusion is integrally connected to inner side surface, facing one end edge of protrusion, of recessed portion. Adequate transcription performance to molding surface can therefore be ensured while removing remains of
(Continued)

air on bottom side of recessed portion of mold for molding protrusions on crown portion back surface during casting.

20 Claims, 17 Drawing Sheets

(51) Int. Cl.

| | |
|---|---|
| ***B22C 9/22*** | (2006.01) |
| ***B22C 9/24*** | (2006.01) |
| ***B22D 19/00*** | (2006.01) |
| ***B22D 29/00*** | (2006.01) |
| ***B22C 9/10*** | (2006.01) |
| ***B22D 15/02*** | (2006.01) |

(52) U.S. Cl.
CPC ..... *B22C 9/22* (2013.01); *B22C 9/24* (2013.01); *B22D 15/02* (2013.01); *B22D 19/0027* (2013.01); *B22D 29/00* (2013.01); *F02F 2003/0007* (2013.01); *F02F 2200/06* (2013.01)

(56) References Cited

U.S. PATENT DOCUMENTS 1,618,601 A * 2/1927 Matthews ..... F16J 1/14 92/215
1,812,391 A * 6/1931 Zechlau ..... F02F 3/003 92/215
2,178,993 A * 11/1939 Hill ..... F16J 9/20 184/18
4,989,559 A * 2/1991 Fletcher-Jones ..... F02F 3/0076 123/193.6
5,081,968 A * 1/1992 Bruni ..... F02B 23/0672 123/193.6
6,318,243 B1 * 11/2001 Jones ..... F02F 3/0015 92/189
7,331,276 B2 * 2/2008 Schle.beta.mann ... F02F 3/0076 92/208
7,431,012 B1 * 10/2008 Glenn ..... F02B 23/0669 123/299
2006/0037471 A1 2/2006 Zhu et al.
2007/0137605 A1 * 6/2007 Scharp ..... F02F 3/0023 123/193.6
2007/0289568 A1 * 12/2007 Scharp ..... F02F 3/0015 123/193.6
2009/0250033 A1 * 10/2009 Scharp ..... F02F 3/22 123/193.6
2010/0107998 A1 * 5/2010 Scharp ..... F02F 3/22 123/41.35
2014/0352647 A1 * 12/2014 Linke ..... F02F 3/22 123/193.6
2015/0354435 A1 * 12/2015 Wirkkala, II ..... F01P 3/10 123/41.35

FOREIGN PATENT DOCUMENTS

JP 56-118938 U1 9/1981
JP 2008-507657 A 3/2008

* cited by examiner

PISTON FOR INTERNAL COMBUSTION ENGINE, AND PRODUCTION METHOD AND PRODUCTION DEVICE FOR PISTON FOR INTERNAL COMBUSTION ENGINE

TECHNICAL FIELD

The present invention relates to a piston for an internal combustion engine, which is provided with a plurality of cooling protrusions on a back surface side of a crown portion of the piston, and relates to an improved technique of a production method and a production device for the piston for the internal combustion engine.

BACKGROUND ART

As a method of cooling a piston for an internal combustion engine, which is subject to heavy heat load during an engine operating condition, various measures have been taken. As one of the cooling measures, for instance, it is disclosed in the following Patent Document 1.

This piston is formed as an integral member with, for instance, aluminum alloy material, and provided with a plurality of cooling fins that are formed integrally with a back surface side opposite to a crown surface of a crown portion and protrude from the back surface of the crown portion. The cooling fins, which are located on the substantially middle side on the back surface, are formed into a substantially linear shape, while the cooling fins, which are located on an outer circumferential side of the middle side-cooling fins, are formed into an arc shape so as to surround the middle side-cooling fins.

A surface area of the back surface side of the crown portion is increased by the plurality of cooling fins formed integrally with the piston, then a cooling effect during a piston drive is increased.

CITATION LIST

Patent Document

Patent Document 1: Japanese Unexamined Utility Model Application Publication No. 56-118938 (JP, 56-118938, U)

SUMMARY OF THE INVENTION

In the case of the piston disclosed in the Patent Document 1, however, each of the cooling fins is formed so as to protrude downward from the back surface of the crown portion. Therefore, in a case where the piston is cast by a Gravity Die Casting Process (Gravity), when pouring molten metal into a mold (or a die) that has recessed portions for molding the cooling fins, since the molten metal flows into an inside (a bottom side) of the recessed portion from an upper end opening side of the recessed portion, the molten metal hardens with air remaining on the bottom side of the recessed portion.

For this reason, an adequate transcription performance to a molding surface of the mold cannot be ensured, thereby not securing a sufficient surface area of the cooling fin. As a consequence, there is a risk that cooling efficiency of the crown portion will be decreased.

The present invention was made in view of the above technical problem. An object of the present invention is therefore to provide a piston for an internal combustion engine, a piston production device and a piston production method, which are capable of ensuring the adequate transcription performance to the molding surface of the mold while removing the remains of the air on the bottom side of the recessed portion of the mold for molding the protrusions on the crown portion back surface during the casting.

A piston for an internal combustion engine recited in claim 1 comprises: a crown portion having a crown surface that defines a combustion chamber; thrust-side and anti-thrust-side skirt portions formed integrally with the crown portion and sliding on a cylinder wall surface; a pair of apron portions joined to the pair of skirt portions in a circumferential direction, each of the apron portions having a pin boss portion provided with a piston pin hole; a recessed portion formed on a back surface that is an opposite side to the crown surface of the crown portion and extending between the both skirt portions along a substantially longitudinal direction; and a plurality of protrusions formed integrally with a bottom surface of the recessed portion and extending along an arrangement direction of the pair of apron portions or an arrangement direction of the pair of skirt portions. And at least one end edge in a longitudinal direction of each of the protrusions is integrally connected to an inner side surface, which faces the one end edge of the protrusion, of the recessed portion.

As a piston production device, the lower mold is provided with a protruding portion for molding the recessed portion, the protruding portion being formed on an upper surface of a middle portion of an inner surface forming portion that forms each surface of the both skirt portions; and a plurality of groove portions for molding the protrusions, the plurality of groove portions being formed on an upper surface of the protruding portion. And, the lower mold is configured so that a height of the middle portion is set to be higher than those of the other portions of the inner surface forming portion of the lower mold by a height of the protruding portion, and a depth of each of the groove portions is set to be shallower than the height of the protruding portion, a height of an opening formed on at least one end side in a longitudinal direction of each of the groove portions is set to be lower than or the substantially same as a bottom surface of the groove portion, and molten metal poured in the lower mold flows to the bottom surface of each of the groove portions from the opening of the groove portion.

According to the present invention, by making the molten metal flow to the bottom surface side of each of the plurality of groove portions of the lower mold, which mold the plurality of protrusions on the back surface of the crown portion of the piston, during casting, the remains of the air is suppressed, and the adequate transcription performance to the molding surface of the mold can be ensured. It is therefore possible to obtain a desired surface area of the protrusions of the piston.

BRIEF DESCRIPTION OF THE DRAWINGS

FIG. 24 shows a piston of a second embodiment.

FIG. 25 shows a piston of a third embodiment.

FIG. 26 shows a piston of a fourth embodiment.

FIG. 27 shows a piston of a fifth embodiment.

EMBODIMENTS FOR CARRYING OUT THE INVENTION

In the following description, embodiments of a piston for an internal combustion engine, a piston production device and a piston production method according to the present invention will be explained. The piston in the embodiments is applied to a spark ignition gasoline engine.

Figure 1:
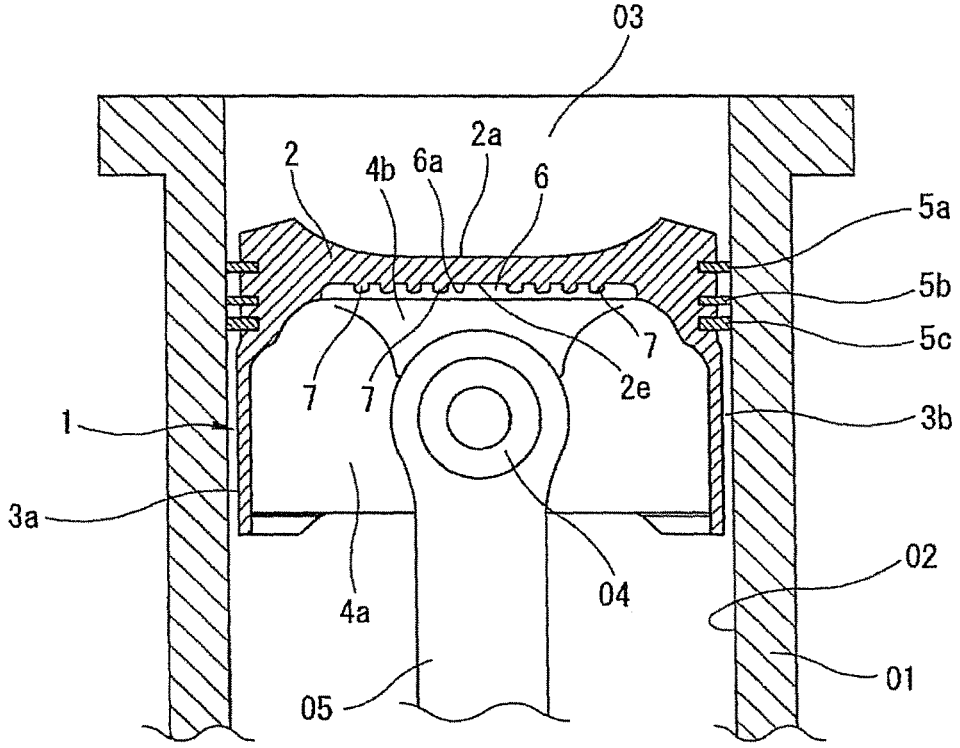
FIG. 1 is a longitudinal cross section showing a state in which a piston according to the present invention for an internal combustion engine slides on a cylinder wall surface.

As shown in FIG. 1, a piston 1 is provided slidably upward and downward on a cylindrical cylinder wall surface 02 that is formed in a cylinder block of an engine. The piston 1 is configured so that a combustion chamber 03 is defined between the cylinder wall surface 02 and a lower surface of a cylinder head (not shown). The piston 1 is linked to a crankshaft (not shown) through a con-rod (connecting rod) 05 connected to a piston pin 04.

Figure 2:
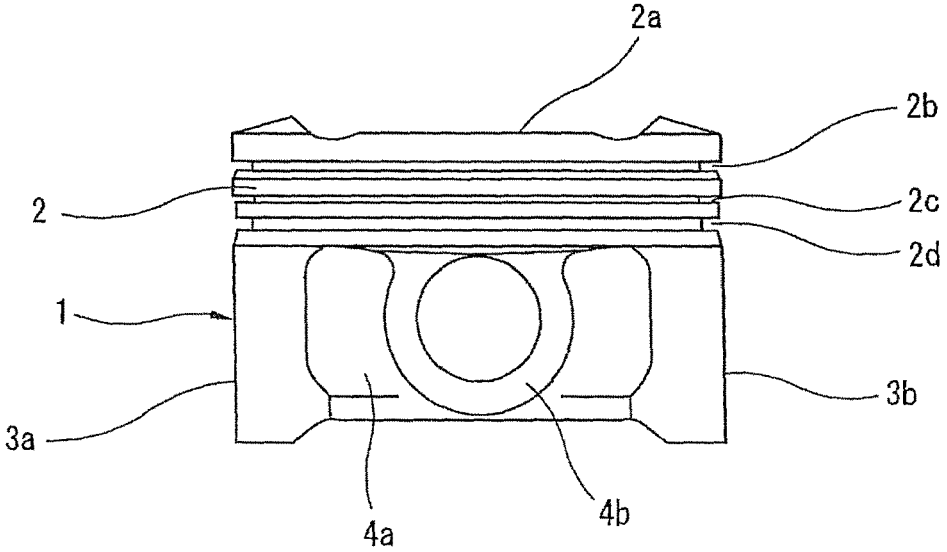
FIG. 2 is a front view of the piston of the present embodiment.
Figure 3:
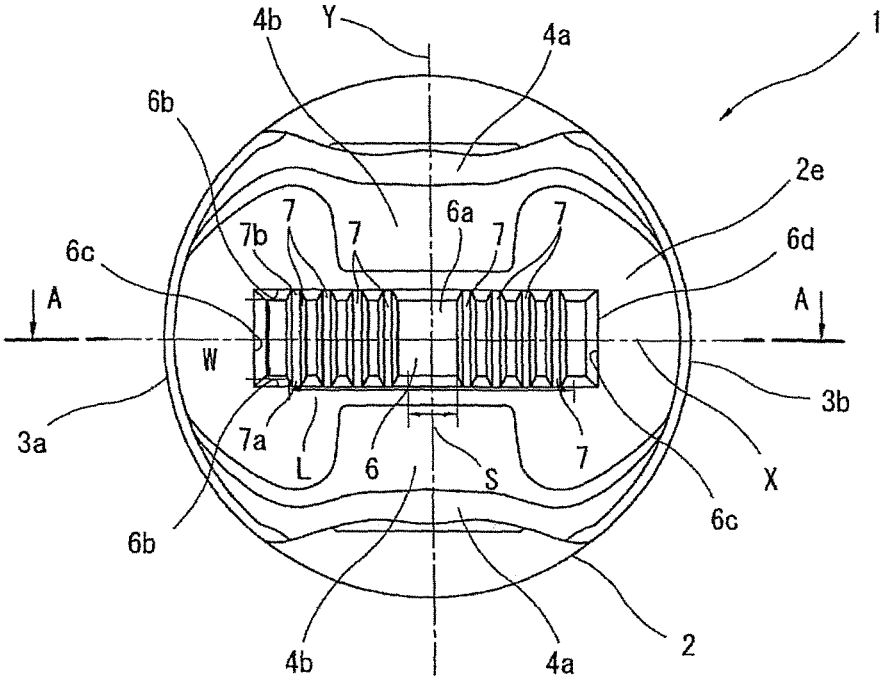
FIG. 3 is a bottom view of the piston.

The piston 1 is cast as an integral member with AC8A Al—Si base aluminium alloy as base material, and as shown in FIGS. 1 to 3, the piston 1 is substantially cylindrical in shape. The piston 1 has a crown portion 2 defining the combustion chamber on and above a crown surface 2*a*, a pair of arc-shaped thrust-side skirt portion 3*a* and arc-shaped anti-thrust-side skirt portion 3*b* formed integrally with a lower end outer circumferential edge of the crown portion 2, and a pair of apron portions 4*a* and 4*a* joined to both side ends in a circumferential direction of the skirt portions 3*a* and 3*b* through respective joining portions. Here, pin boss portions 4*b*and 4*b* that support both ends of the piston pin through piston pin holes 4*c* and 4*c* (not shown) are formed integrally with the apron portions 4*a* and 4*a*.

The crown portion 2 has a relatively thick disc shape. The crown portion 2 is provided, on the crown surface 2*a* defining the combustion chamber 03, with a valve recess (not shown) to prevent interference with an intake valve and an exhaust valve. An outer circumferential portion of the crown surface 2*a* is shaped into a protruding circumference. The crown portion 2 has, at the outer circumferential portion thereof, three piston ring grooves 2*b*, 2*c* and 2*d* in which pressure rings and/or oil rings 5*a* to 5*c* are fitted.

Further, as shown in FIGS. 1 and 3 to 5, a rectangular recessed portion 6 is formed on a back surface 2*e* that is an opposite side to the crown surface 2*a* of the crown portion 2. On a bottom surface 6*a* of the recessed portion 6, a plurality of protrusions 7 are formed integrally with the bottom surface 6*a*.

Figure 4:
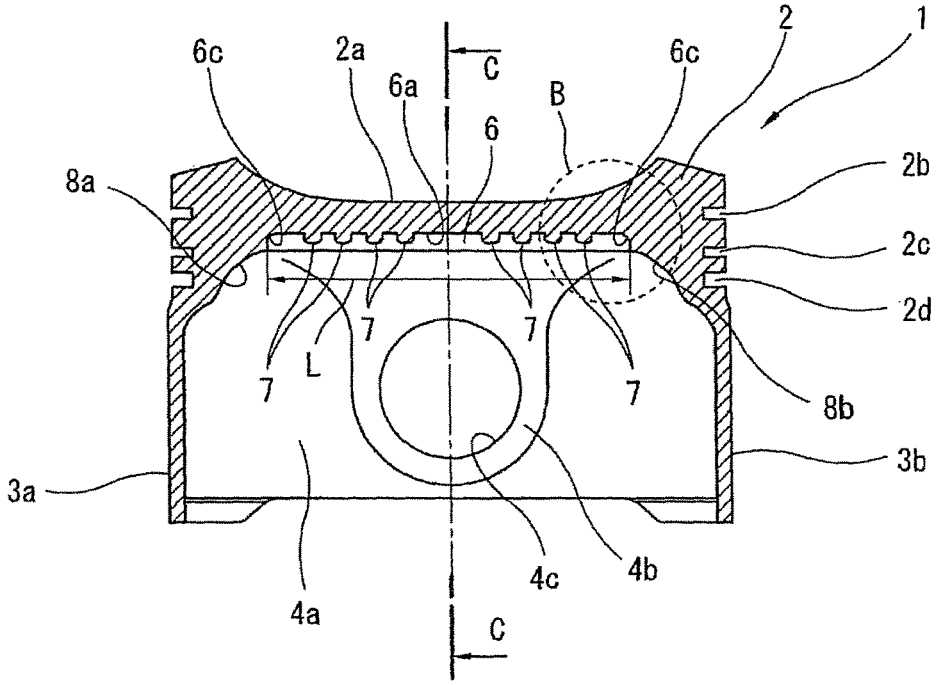
FIG. 4 is a longitudinal cross section taken along A-A line of FIG. 3.
Figure 6:
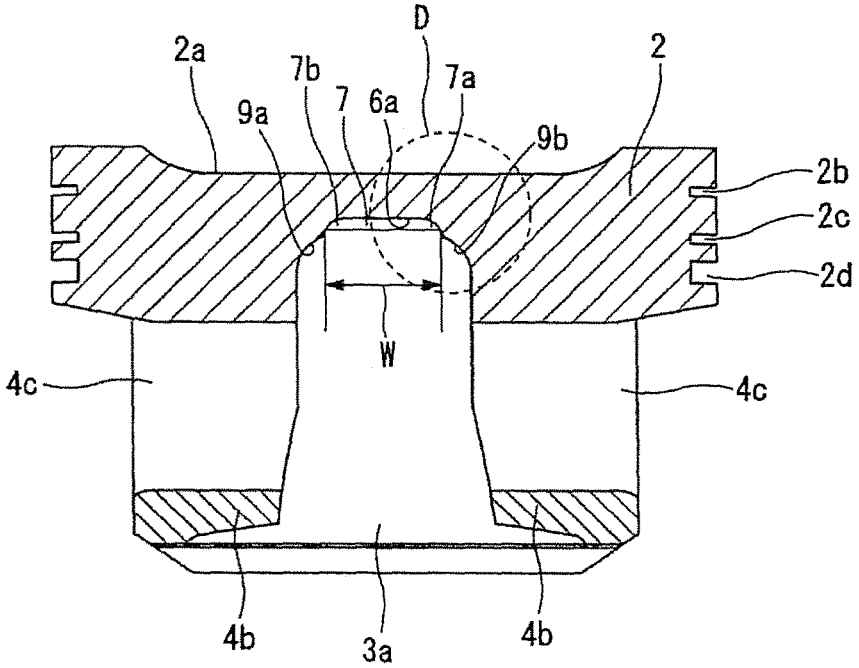
FIG. 6 is a longitudinal cross section taken along C-C line of FIG. 4.

As shown in FIG. 3, the recessed portion 6 is formed into the rectangular shape so as to extend along an axial line X connecting centers of the skirt portions 3*a* and 3*b* (in a direction orthogonal to an axis line Y of the pin boss portions 4*b* and 4*b*). More specifically, also as shown in FIG. 4, the recessed portion 6 has a length L at a long side of the recessed portion 6, which substantially extends to arc-shaped upper wall surfaces 8*a* and 8*b* that are connecting portions with the skirt portions 3*a* and 3*b* of the crown portion 2. Further, also as shown in FIG. 6, the recessed portion 6 has a width W at a short side of the recessed portion 6, which substantially extends to arc-shaped upper wall surfaces 9*a* and 9*b* that are connecting portions with the pin boss portions 4*b* and 4*b*.

Figure 5:
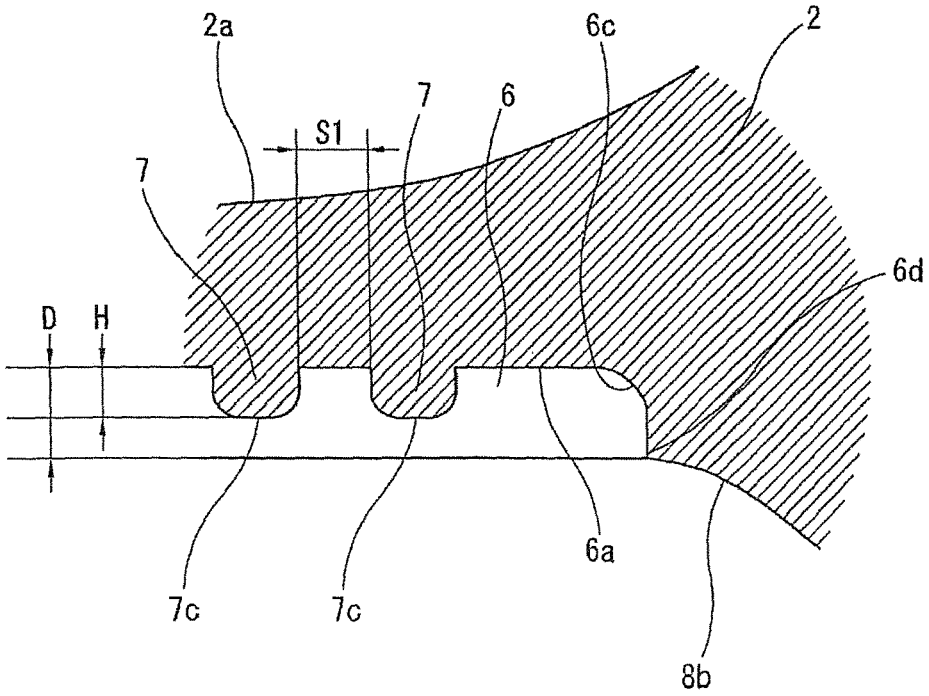
FIG. 5 is an enlarged view of B-section of FIG. 4.
Figure 7:
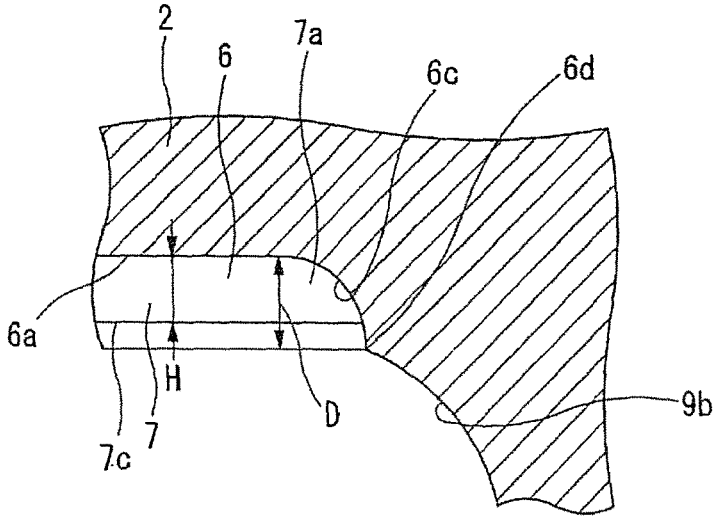
FIG. 7 is an enlarged view of D-section of FIG. 6.

As shown in FIGS. 5 and 7, each of opposing inner side surfaces 6*b* and 6*b* at the long side of the recessed portion 6 and each of opposing inner side surfaces 6*c* and 6*c* at the short side of the recessed portion 6 are formed into an arc shape that extends downward from the bottom surface 6*a*. Each outer peripheral edge 6*d* is connected to the arc-shaped upper wall surfaces 8*a*, 8*b*, 9*a* and 9*b* not smoothly, but stepwise.

As shown in FIG. 3, the protrusions 7 are formed integrally with the bottom surface 6*a* of the recessed portion 6. The protrusions 7 are divided into two groups at right and left sides with a predetermined span S provided with the axis line Y of the pin boss portions 4*b* and 4*b* being a center line, i.e. through a rectangular middle portion of the recessed portion bottom surface 6*a*. That is, the protrusions 7 are divided between a group of four protrusions 7 on the thrust-side skirt portion 3*a* side and a group of four protrusions 7 on the anti-thrust-side skirt portion 3*b* side, and eight protrusions 7 are provided in total.

Each of the protrusions 7 in the two groups is formed into a linear shape along the axis line Y of the pin boss portions 4*b* and 4*b*. That is, the protrusions 7 are formed along an opposing direction of the pair of apron portions 4*a* and 4*a*, and arranged parallel to each other with a predetermined width clearance S1 provided between them. Further, both end portions 7*a* and 7*b* of the protrusion 7 are joined or connected to the opposing inner side surfaces 6*b* and 6*b* at the long side of the recessed portion 6, and an outer surface 7*c* of the protrusion 7 is formed into a substantially arc shape in cross section. As shown in FIGS. 5 and 7, a height H of the protrusion 7 is set to be slightly lower than a depth D of the recessed portion 6.

As explained above, since the recessed portion 6 and the protrusions 7 are formed on the back surface 2*e* side of the crown portion 2 of the piston 1, a surface area of the whole back surface 2*e* is increased as compared with a case where no recessed portion 6 and no protrusions 7 are formed.

Because of this, a heat radiation effect in an area of the recessed portion 6 where the protrusions 7 are provided is increased, and cooling efficiency of the crown portion 2 and the piston 1 around the crown portion 2 can be promoted.

In particular, since a top end surface 7*c* of the protrusion 7 is formed into the arc shape, the surface area of the whole back surface 2*e* is increased, thereby further increasing the heat radiation effect.

In addition, each of the opposing inner side surfaces 6*b* and 6*b* at the long side of the recessed portion 6 and each of the opposing inner side surfaces 6*c* and 6*c* at the short side of the recessed portion 6 are formed into the arc shape that extends downward from the bottom surface 6*a*, and each outer peripheral edge 6*d* is connected to the arc-shaped upper wall surfaces 8*a*, 8*b*, 9*a* and 9*b* not smoothly, but stepwise. Therefore, by these structures, a surface area of the area of the recessed portion 6 is increased, and a good heat radiation effect can be obtained, then the cooling efficiency can be improved.

[Casting Mold Device for Piston]

Figure 8:
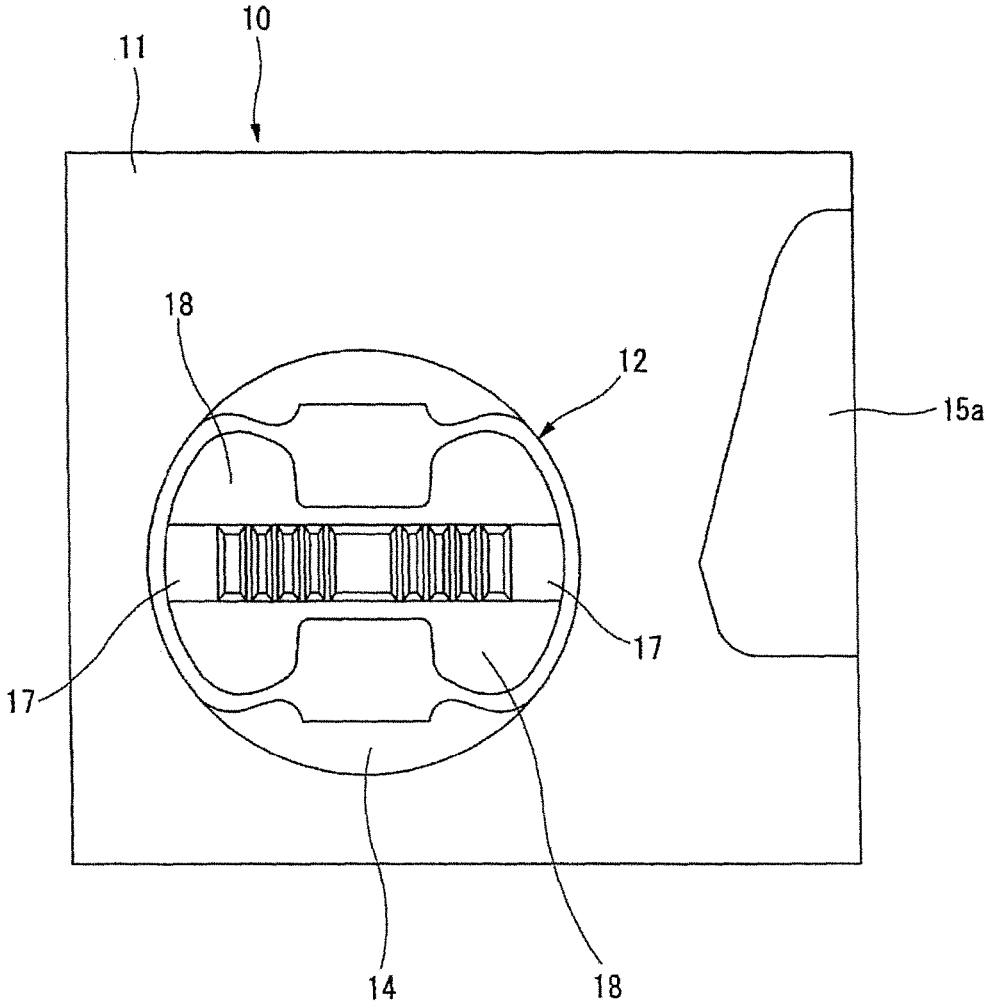
FIG. 8 is a top view of a casting mold device of the present embodiment with a top core removed.
Figure 9:
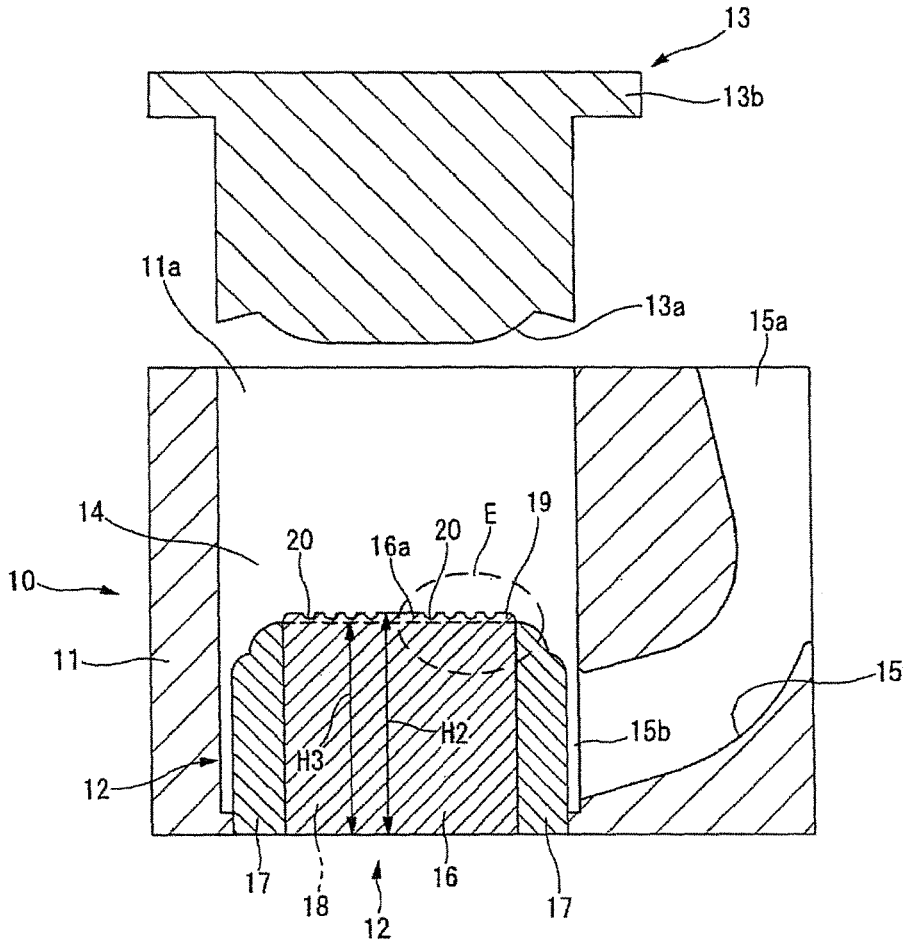
FIG. 9 is a longitudinal cross section of the casting mold device.
Figure 10:
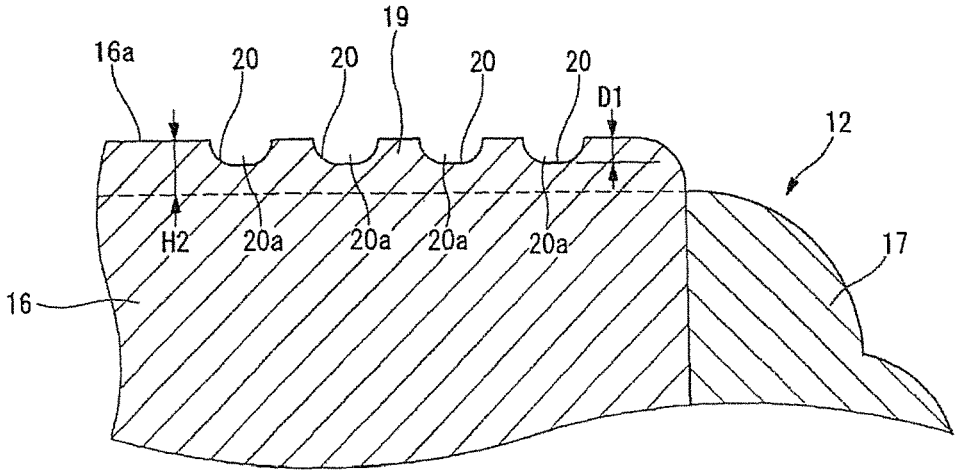
FIG. 10 is an enlarged view of E-section of FIG. 9.
Figure 11:
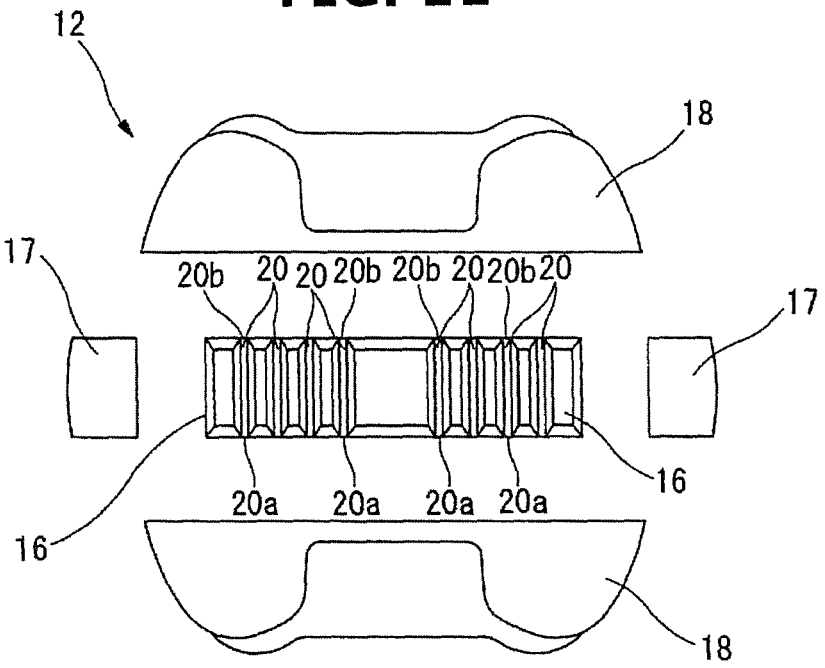
FIG. 11 is an exploded top view of a core of the casting mold device of the present embodiment.
Figure 12:
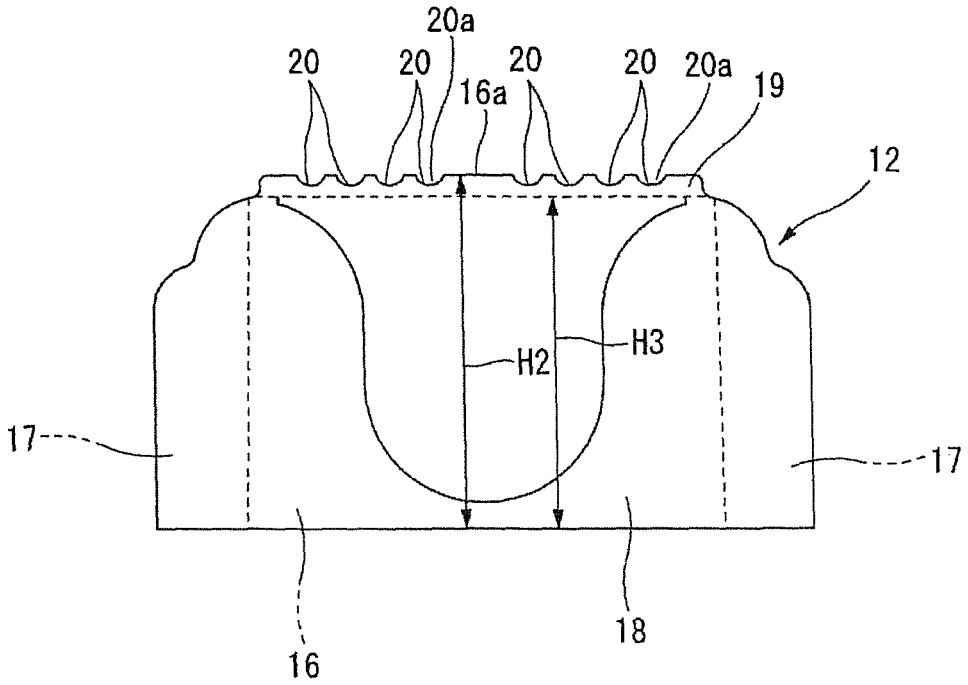
FIG. 12 is a front view showing a state in which cores are clamped together.
Figure 13:
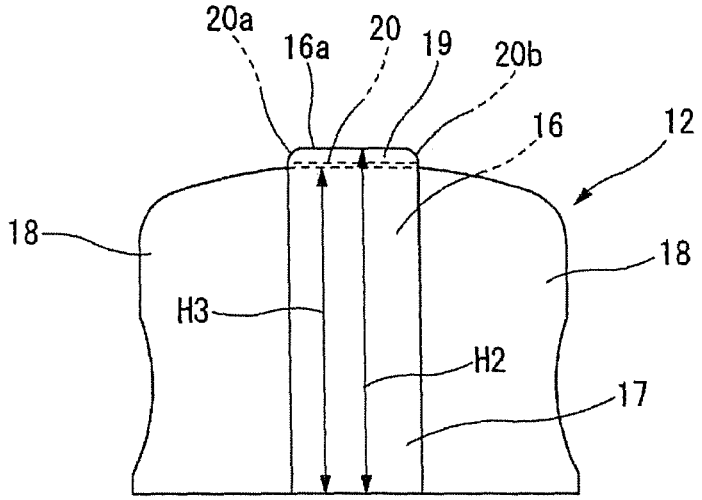
FIG. 13 is a right side view showing the state in which the cores are clamped together.
Figure 14:
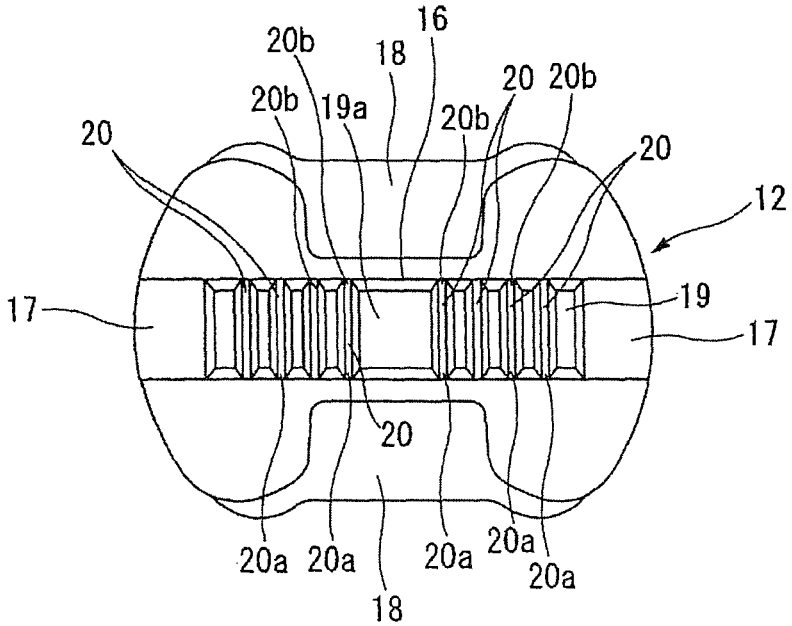
FIG. 14 is a downward view showing the state in which the cores are clamped together.
Figure 15:
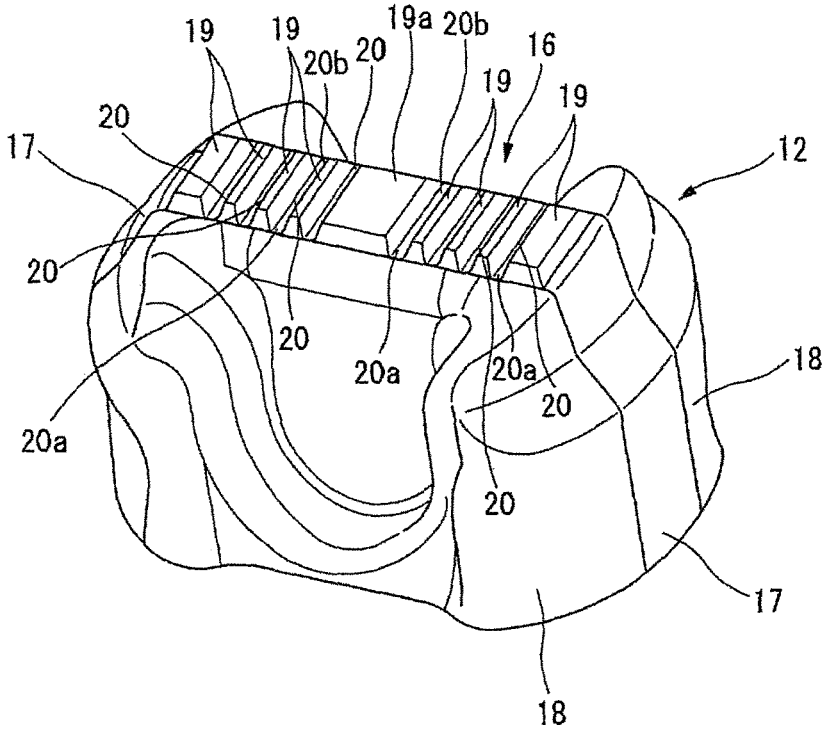
FIG. 15 is a perspective view showing the state in which the cores are clamped together.

As a casting mold 10 for casting the piston 1, as shown in FIGS. 8 and 9, the casting mold 10 is formed mainly by a mold 11 that is an outer mold, a core 12 that is a lower mold provided on an inner lower side of the mold 11, a top core 13 that is an upper mold provided on an upper side of the mold 11, and a cavity 14 that is defined by these mold and cores 11 to 13.

The mold 11 is provided with a runner (or a pouring duct) 15 to pour molten metal into the cavity 14. This runner 15 has, at an upstream side thereof, a pouring opening 15*a*. A downstream portion 15*b* of the runner 15 communicates with a lower side of the cavity 14.

The core 12 is a portion that molds the crown surface 2*a*, the skirt portions 3*a* and 3*b* and the apron portions 4*a* and 4*a* of the piston 1 in cooperation with an inner surface of the mold 11 and a lower surface 13*a* of the top core 13.

That is, as shown in FIGS. 11 to 15, the core 12 is formed by combining a plurality of divided cores. The core 12 has a substantially plate-shaped center core 16 that is a middle portion located in the middle and molding the recessed portion 6 and the protrusions 7, two philip cores 17 and 17 located at both sides, in the drawing, of the center core 16 and mainly molding middle portion inner surfaces in a circumferential direction of the skirt portions 3*a* and 3*b*, and two side cores 18 and 18 located at upper and lower sides, in the drawing, of the center core 16 and mainly molding the apron portions 4*a* and 4*a* including the pin boss portions 4*b* and 4*b*.

As shown in FIGS. 9 to 15, the center core 16 is formed into a rectangular shape so that an upper end surface 16*a* extends to the both philip cores 17 and 17 sides. A height H2 from a lower end surface to the upper end surface 16*a* of the center core 16 is set to be higher than those of the philip cores 17 and 17 and the side cores 18 and 18. This height difference forms a protruding portion 19 to form the recessed portion 6 on the back surface 2*e* of the crown portion 2.

The protruding portion 19 is formed throughout the upper end surface 16*a* of the center core 16, and a plurality of groove portions 20 to form the protrusions 7 on the back surface 2*e* side of the crown portion 2 are formed on this upper surface (the upper end surface 16*a*). That is, the groove portions 20 are divided into two groups each formed from four groove portions 20 at both philip core 17 sides on opposite sides of a rectangular middle upper end surface 19*a* of the protruding portion 19. Each of the groove portions 20 is formed into a linear shape along a width direction of the protruding portion 19 between the both side cores 18 and 18. Further, each of the groove portions 20 is formed into a substantially arc shape in cross section. Furthermore, a depth D1 of each groove portion 20 is set to be shallower than the height H2 of the protruding portion 19. Openings 20*a* and 20*b* are formed at both end portions in an axial direction of the groove portion 20.

The top core 13 is placed so as to be able to open and close an upper end opening 11*a* of the mold 11 by a hoisting and lowering machine formed by a cylinder etc. (not shown) and so as to mold the crown surface 2*a* of the crown portion 2 by a cavity surface 13*a* that is a lower end surface of the top core 13.

That is, the cavity surface 13*a* of the top core 13, which faces the core 12, is formed as a transcription surface to transfer the crown surface 2*a* of the piston 1 when pouring the molten metal of the aluminium alloy into the cavity 14 and molding the piston 1 as a product.

The top core 13 is provided, at an upper end portion outer periphery thereof, a flange portion 13*b* that is formed integrally with the top core 13 so that when a core body of the top core 13 enters the mold 11 from the upper end opening 11*a* by the hoisting and lowering machine, by the fact that the flange portion 13*b* contacts an upper end opening edge of the mold 11, a further movement of the top core 13 is restrained or limited.

[Casting Method for Piston]

To cast the piston 1 using the casting mold 10, the cores 16 to 18 of the core 12 are clamped together in the mold 11. Subsequently, as shown in FIG. 16, the top core 13 located in a position shown in FIG. 9 is moved down until the flange portion 13*b* of the top core 13 contacts the hole edge of the upper end opening 11*a* of the mold 11, and these cores are clamped together (a clamping process).

Figure 16:
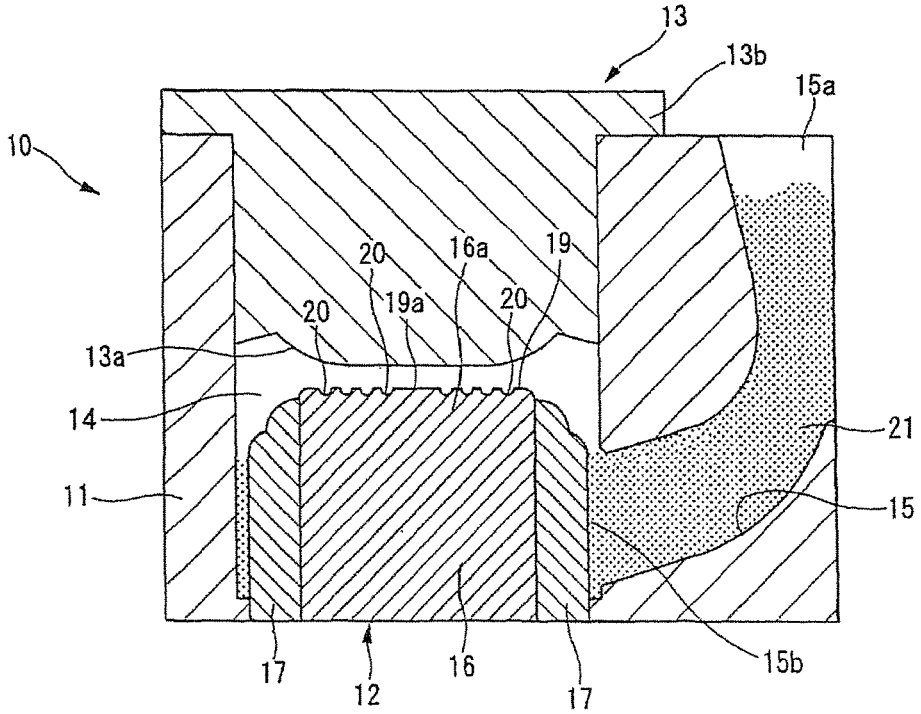
FIG. 16 is an explanatory drawing showing an early state in which aluminum alloy material molten metal is poured into a cavity of the casting mold device.
Figure 17:
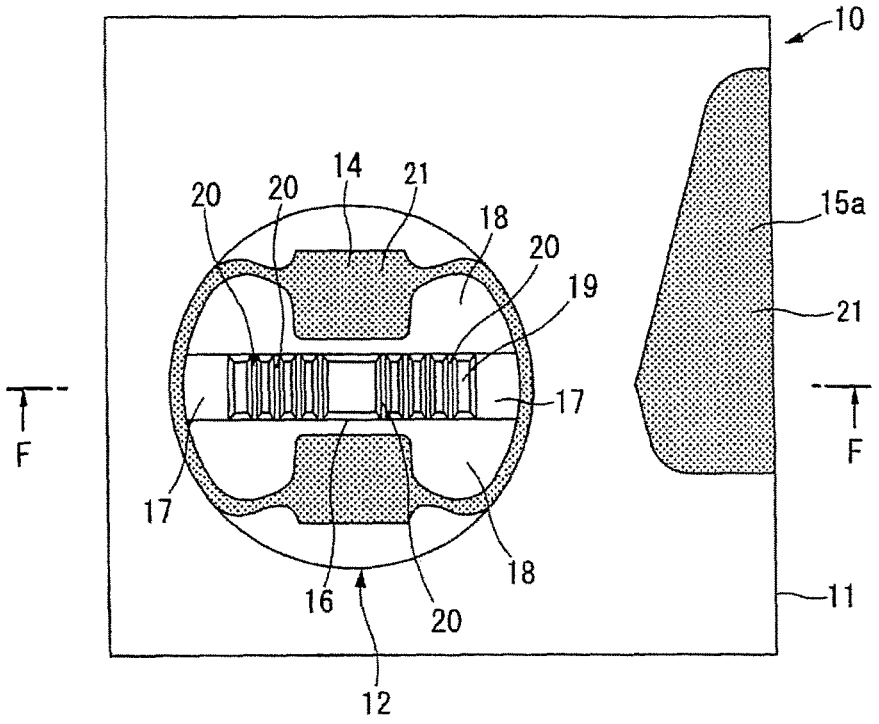
FIG. 17 is an explanatory drawing showing a state in which the aluminum alloy material molten metal is further poured into the cavity of the casting mold device.
Figure 22:
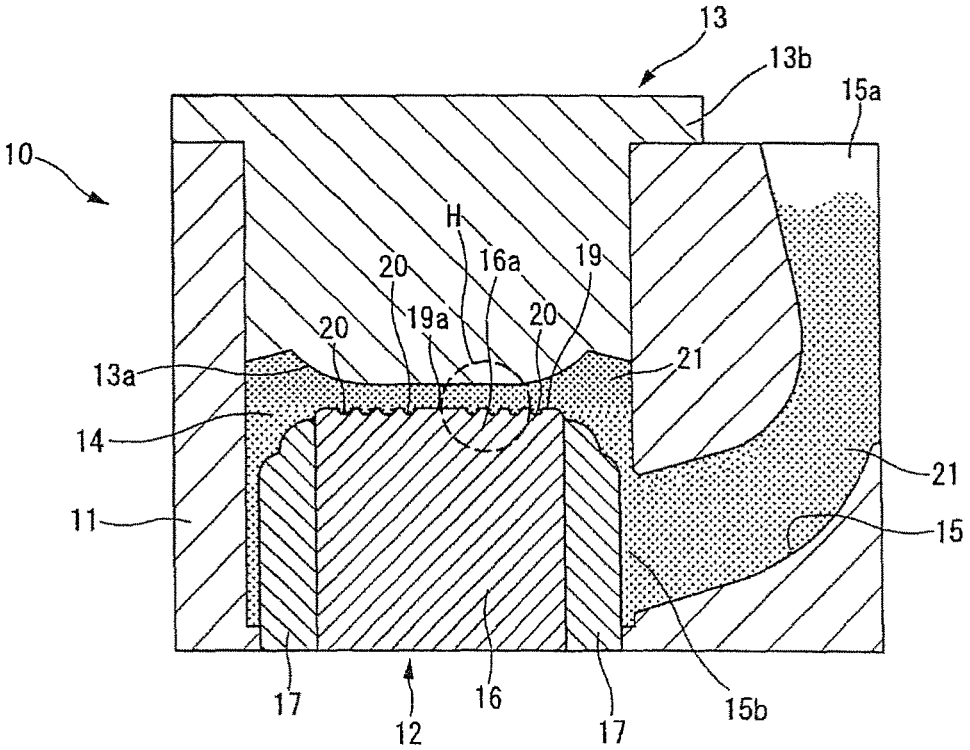
FIG. 22 is an explanatory drawing showing a state in which the cavity is filled with the aluminum alloy material molten metal.
Figure 23:
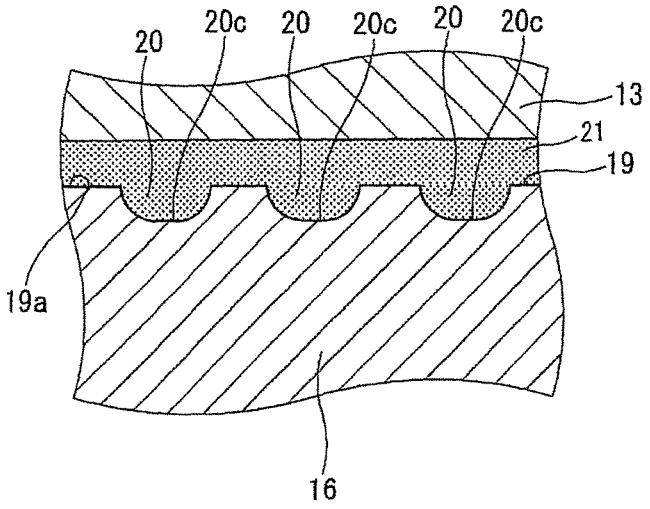
FIG. 23 is an enlarged view of H-section of FIG. 22.

After this clamping, as shown in FIGS. 16 and 17, molten metal 21 of the aluminium alloy is poured into the cavity 14 gradually or little by little from the pouring opening 15*a* of the mold 11 through the runner 15, and the aluminium alloy molten metal 21 comes into the cavity 14 from a lower side of the cavity 14, then as shown in FIG. 22, the cavity 14 is filled with the aluminium alloy molten metal 21 (a pouring process).

Figure 18:
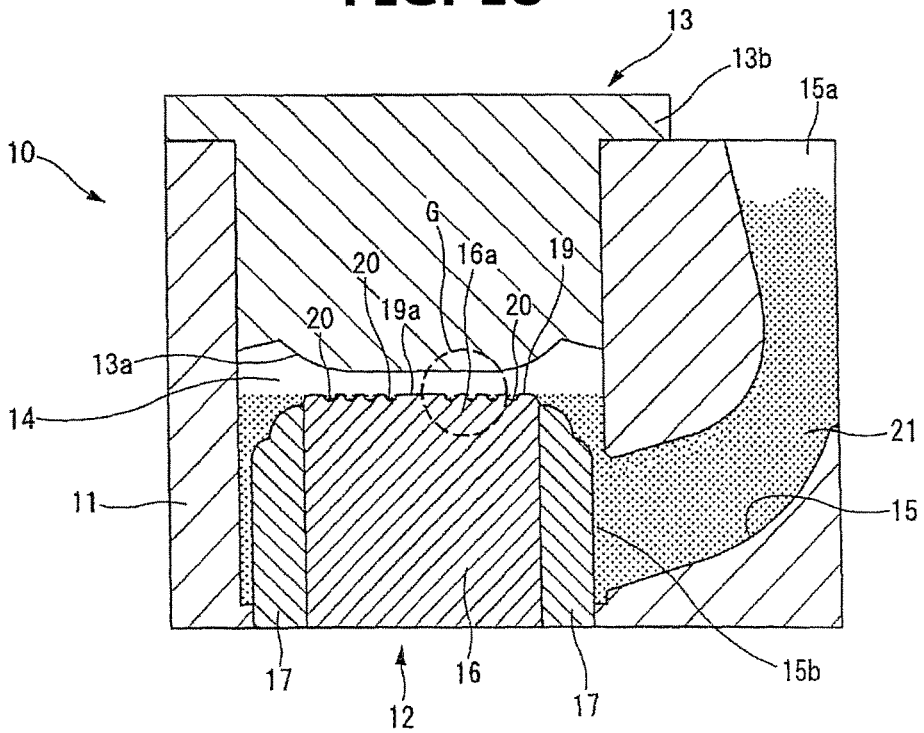
FIG. 18 is a longitudinal cross section taken along F-F line of FIG. 17.
Figure 20:
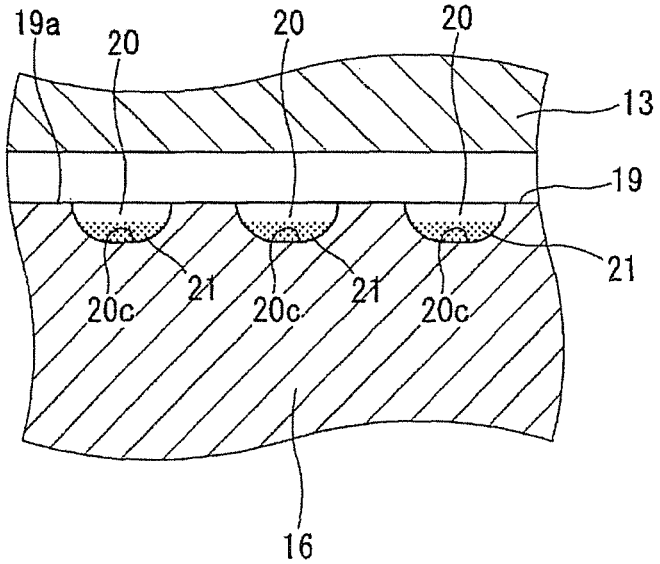
FIG. 20 is an enlarged view of G-section of FIG. 18.
Figure 21:
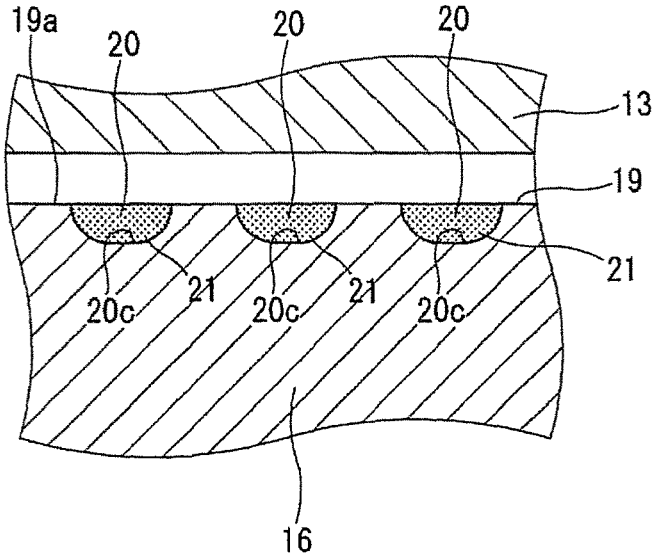
FIG. 21 is an enlarged view of G-section of FIG. 18, showing a state in which the aluminum alloy material molten metal further gradually rises to each groove portion.

With this pouring, as shown in FIG. 18, the aluminium alloy molten metal 21 supplied in the cavity 14 gradually rises along each outer surface of the center core 16, the both philip cores 17 and 17 and the both side cores 18 and 18 inside the cavity 14. Then, when the aluminium alloy molten metal 21 reaches the upper end portion 16*a* of the center core 16, as shown by a solid line arrow in FIG. 19, the aluminium alloy molten metal 21 flows around both outer surface sides of the side cores 18 and 18, and further flows into a bottom surface 20*c* side from each of the openings 20*a* and 20*b* of the groove portions 20. Then, as shown in FIGS. 20 and 21, the aluminium alloy molten metal 21 gradually rises in an upper end direction from the bottom surface 20*c* side (a flowing process).

Afterwards, as shown in FIG. 22, when finally the aluminium alloy molten metal 21 completely fills the cavity 14, the groove portions 20 and the upper surface of the protruding portion 19 are also filled with the aluminium alloy molten metal 21, and the crown surface 2*a* of the crown portion 2 and the whole back surface 2*e* including the recessed portion 6 and the protrusions 7 are formed.

That is, in this state, the aluminium alloy molten metal 21 is in absolute contact with the inner surface of the mold 11, an outer surface of the core 12 and the cavity surface 13*a* of the top core 13, and these shapes are transferred.

Especially in the present embodiment, the aluminium alloy molten metal 21 is poured into the cavity 14 from the pouring opening 15*a* through the runner 15, and flows into the cavity 14 from the lower side of the cavity 14. Here, an area or a part at the crown portion 2 side in the cavity 14 is an area or a part where flows of the aluminium alloy molten metal 21 meet and incomplete casting (or bad casting), e.g. poor flow of the molten metal, which is caused by the fact that air is captured and remains in the aluminium alloy molten metal 21, tends to occur.

Figure 19:
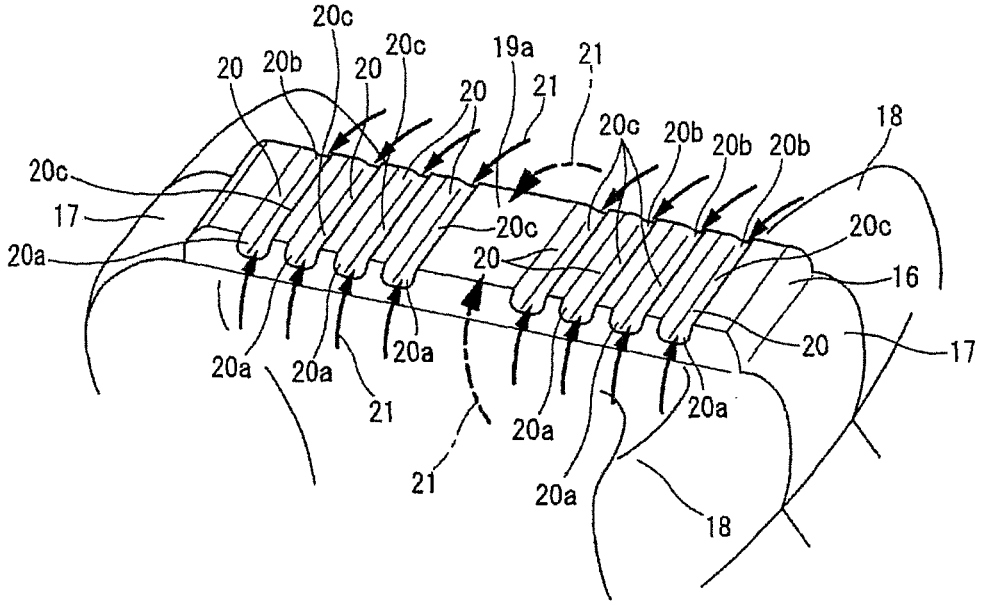
FIG. 19 is an explanatory drawing showing a state in which gradually rising aluminum alloy material molten metal flows into each groove portion from an upper portion side of the core.

However, in the present embodiment, as described above, although the aluminium alloy molten metal 21 flows into each of the groove portions 20, the aluminium alloy molten metal 21 does not flow into the groove portions 20 from the upper end opening side by flowing over the protruding portion 19 as shown by a broken line arrow in FIG. 19, but flows to the bottom surface 20*c* side from both end openings 20*a* and 20*b* of the groove portions 20 while gradually rising then flows into each of the groove portions 20 before flowing over the protruding portion 19 as shown by the solid line arrow in FIG. 19.

Therefore, the air does not enter an area or a part between the aluminium alloy molten metal 21 and the bottom surface 20*c* in each groove portion 20, and the aluminium alloy molten metal 21 is immediately in absolute contact with the whole inner surface including the bottom surfaces 20*c* of the groove portions 20. Good transcription performance of the shape can therefore be obtained. It is consequently possible to sufficiently secure a surface area of each of the protrusions 7 formed by each of the groove portions 20.

Further, the aluminium alloy molten metal 21 after flowing into each groove portion 20 spreads or extends throughout an outer surface of the protruding portion 19 so as to gradually cover the entire outer surface of the protruding portion 19 while keeping the absolute contact with the outer surface of the protruding portion 19. It is therefore possible to secure a large surface area of an inner surface of the recessed portion 6 formed by the protruding portion 19.

Here, after finishing filling the cavity 14 with the aluminium alloy molten metal 21 and cooling the aluminium alloy molten metal 21 for a predetermined time, the casting mold 10 is opened, and base material of the piston 1 is taken out (a taking-out process).

Afterwards, by mechanically cutting surfaces etc. of the piston base material, a molding work of the piston 1 shown in FIG. 2 is completed.

As explained above, according to the piston 1 of the present embodiment, the surface area of the back surface 2*e* of the crown portion 2 is increased by the recessed portion 6. Especially regarding the protrusion 7, since each of the protrusions 7 formed in the recessed portion 6 has no influence of the air in the casting process and the transcription performance can be obtained, a large surface area of the protrusion 7 can be secured. Accordingly, the heat radiation effect of the crown portion 2 is increased together with the heat radiation effect of the recessed portion 6. As a consequence, the cooling efficiency of the crown portion 2 can be improved.

Further, as explained above, the outer peripheral edge 6*d* of each of the inner side surfaces 6*b*, 6*b*, 6*c* and 6*c* of the recessed portion 6 is connected to the arc-shaped upper wall surfaces 8*a*, 8*b*, 9*a* and 9*b* not smoothly, but stepwise. Therefore, also by these structures, the surface area of the area of the recessed portion 6 is increased. Hence, the surface area of the whole back surface 2*e* is increased also by the increase of the surface area of the protrusion 7, thereby obtaining good heat radiation effect and promoting the cooling efficiency.

Furthermore, according to the piston production device and the piston production method, an orientation of a longitudinal direction of each of the groove portions 20 is set along the width direction of the protruding portion 19, and each of the openings 20*a* and 20*b* is formed so as to face the both side cores 18 and 18 along which the aluminium alloy molten metal 21 gradually rises. Moreover, the height of the bottom surface 20*c* of each of the groove portions 20 is set to a higher position than the upper end surfaces of the philip cores 17 and 17 and the side cores 18 and 18. Thus, the aluminium alloy molten metal 21 easily flows into each of the groove portions 20.

Consequently, since flowing performance of the aluminium alloy molten metal 21 into the groove portions 20 is improved and the air does not remain in the groove portions 20, it is possible to mold the protrusions 7 accurately.

With this, since a large surface area of the protrusion 7 can be secured, the heat radiation effect is further increased, and the cooling efficiency can be further improved.

In addition, only by providing the protruding portion 19 at the center core 16 and setting the depth D1 of each groove portion 20 to be lower than the height of the protruding portion 19, high accuracy of the surface is ensured with the influence of the air removed. This thus facilitates the molding work, and reduces a cost.

Further, since each of the groove portions 20 is formed into the linear shape along the direction of the apron portions 4*a* and 4*a*, the molten metal can be easily filled. The reason of this is because when pouring the aluminium alloy molten metal 21 into the mold, although the aluminium alloy molten metal 21 gradually rises from a gravity direction lower side, at a stage where the crown portion 2 is formed, a speed with which the aluminium alloy molten metal 21 gathers toward the middle of the crown portion 2 from directions of the apron portions 4*a* and 4*a* is greater than that from directions of the skirt portions 3*a* and 3*b*. That is, since the crown portion 2 at the apron portions 4*a* and 4*a* sides are formed earlier, the aluminium alloy molten metal 21 flows into the groove portions 20 earlier, then the good transcription performance of the shape of each of the protrusions 7 by each of the groove portions 20 can be obtained.

Second Embodiment

Figure 24A:
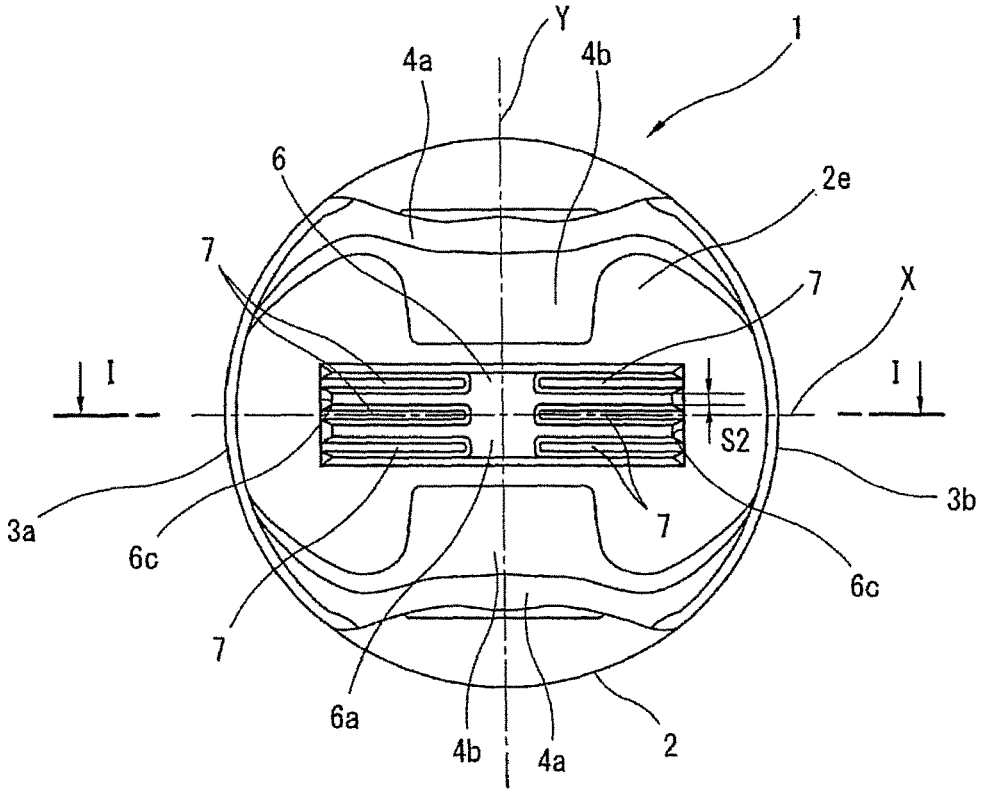
FIG. 24A is a bottom view of the piston.
Figure 24B:
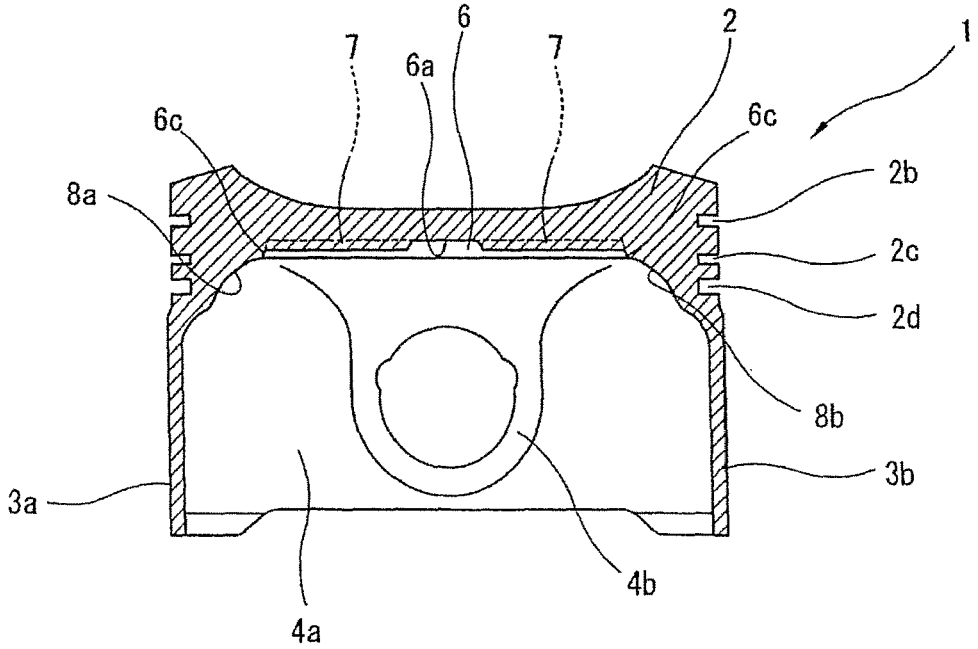
FIG. 24B is a longitudinal cross section taken along I-I line of FIG. 24A.

FIGS. 24A and 24B show a second embodiment of the present invention. A basic structure of the second embodiment is the same as that of the first embodiment. However, arrangement of the protrusions 7 are changed, which is a different point from the first embodiment.

That is, on the back surface 2*e* side of the crown portion 2 of the piston 1, the rectangular recessed portion 6 extending between the skirt portions 3*a* and 3*b*, which is the same as the first embodiment, is formed, and two groups of the protrusion 7, each of which has three protrusions 7, are formed at right and left sides on opposite sides of the middle portion of the recessed portion 6. The protrusions 7 are arranged parallel to each other in three rows with a predetermined width clearance S2 provided between them. Each of the protrusions 7 is formed so as to extend along the longitudinal direction of the recessed portion 6, i.e. along an arrangement direction of the pair of thrust-side skirt portion 3*a* and anti-thrust-side skirt portion 3*b*. Although the number of the protrusions 7 is smaller than that of the first embodiment, each of the protrusions 7 has a long length, then a large surface area is secured.

The other structures or configurations, such as the height of the protrusion 7 which is set to be lower than the depth of the recessed portion 6, are the same as those of the first embodiment.

Further, the piston production method and the piston production device of this piston 1 are the same as those of the first embodiment, except that an arrangement and the number of the groove portions 20 to mold the protrusions 7 are different from those of the first embodiment. Therefore, the present embodiment can obtain the same working and effects as those of the first embodiment.

Third Embodiment

Figure 25A:
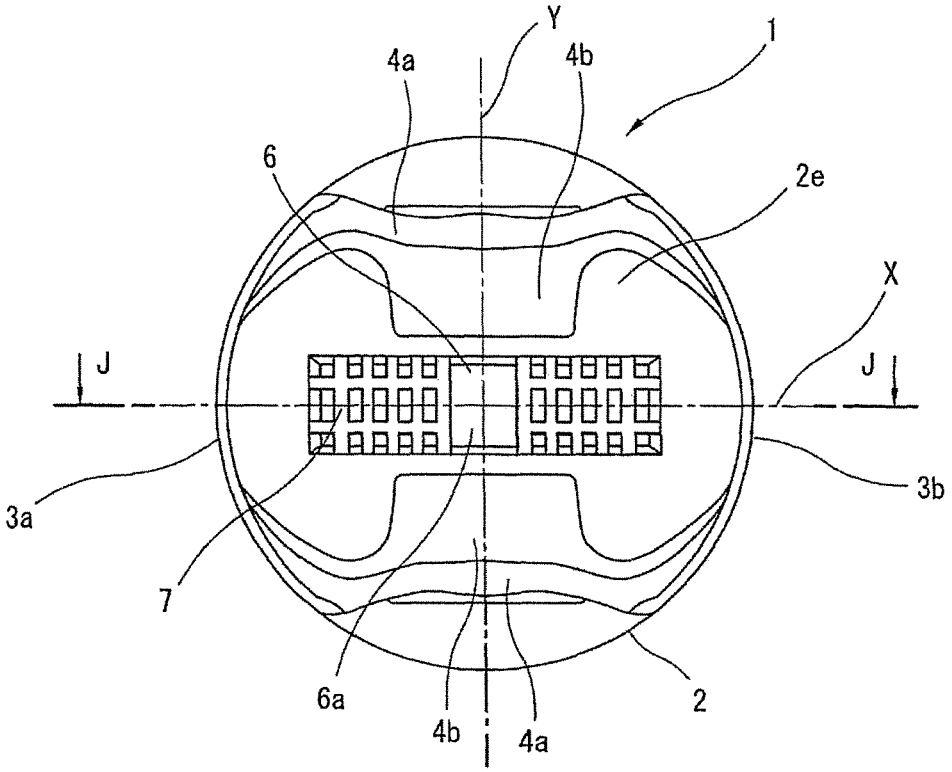
FIG. 25A is a bottom view of the piston.
Figure 25B:
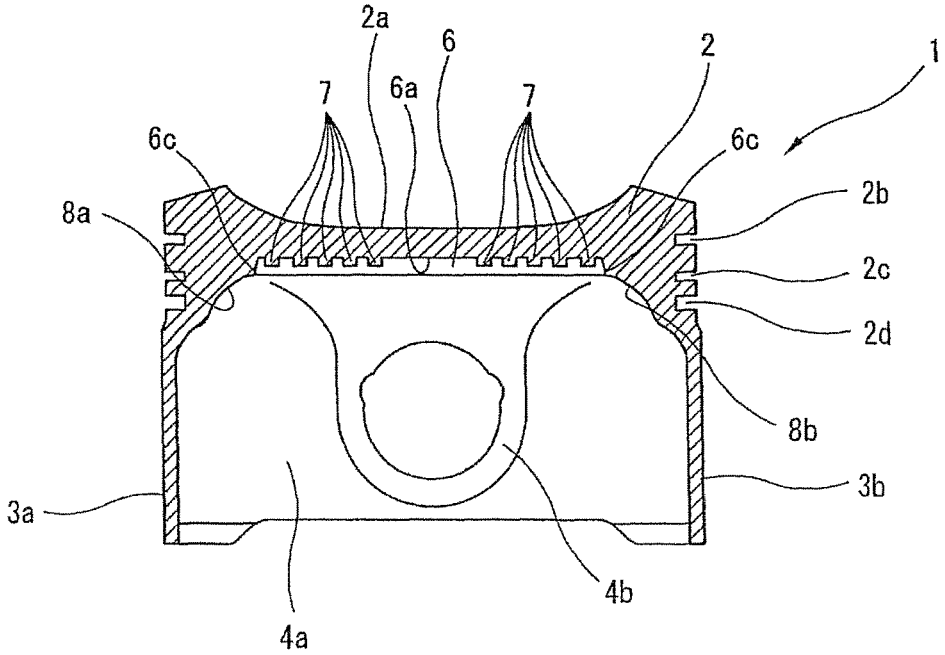
FIG. 25B is a longitudinal cross section taken along J-J line of FIG. 25A.

FIGS. 25A and 25B show a third embodiment of the present invention. Basic structures of the piston and the piston production device and a basic method of the piston production method of the third embodiment are the same as those of the first and second embodiments. However, the number of the protrusions 7 and a length of the protrusion 7 are changed, which are different points from the first and second embodiments.

That is, two protrusion groups at right and left sides are formed at an inner side of the recessed portion 6 formed on the back surface 2*e* side of the crown portion 2 of the piston 1. Each of the protrusions 7 is formed so that a length of the protrusion 7 is short. The protrusions 7 in each group are arranged parallel to each other in five lines along a direction of the pin boss portions 4*b* and 4*b*, and also arranged parallel to each other in two rows along a direction of the skirt portions 3*a* and 3*b*. With this arrangement, the bottom surface 6*a* of the recessed portion 6 forms a grid pattern or a lattice pattern.

Therefore, although this embodiment can obtain the same working and effects as those of the first and second embodiments, a surface area of the grid-patterned (or the lattice-patterned) bottom surface 6*a* of the recessed portion 6 is greater than that of the other embodiments. Also, a surface area of each protrusion 7 itself is greater than that of the other embodiments. Thus, the heat radiation effect also becomes greater. As a result, the cooling efficiency of the crown portion 2 can be further improved.

Fourth Embodiment

Figure 26A:
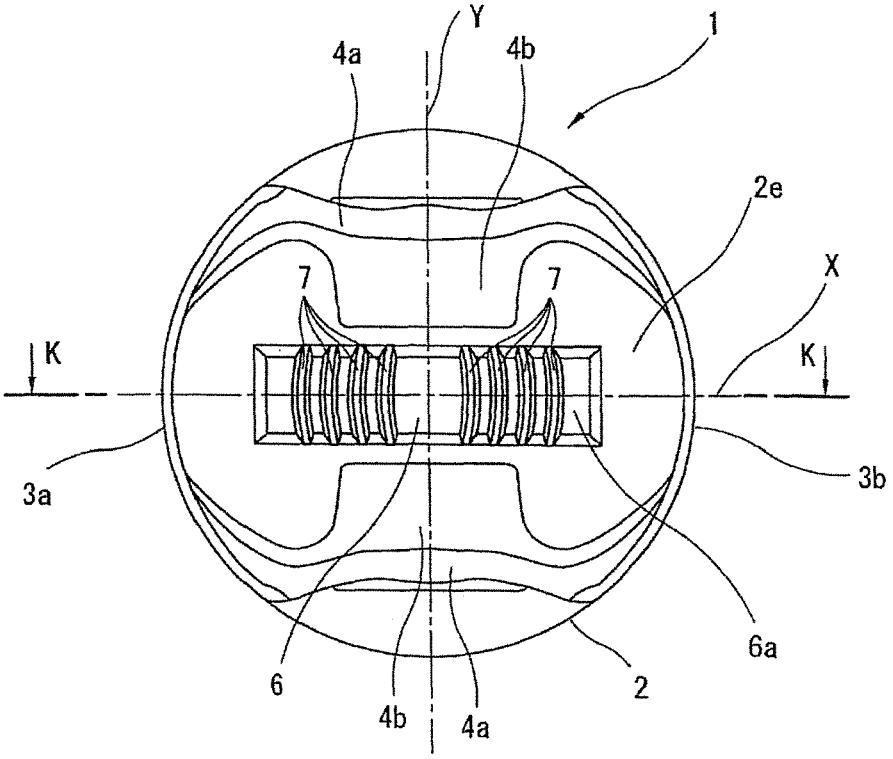
FIG. 26A is a bottom view of the piston.
Figure 26B:
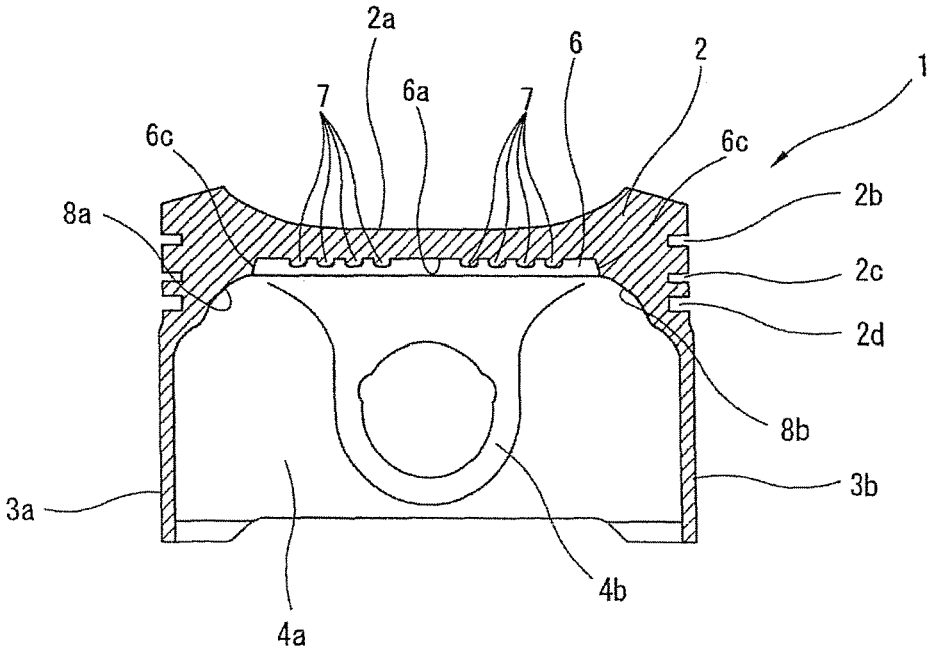
FIG. 26B is a longitudinal cross section taken along K-K line of FIG. 26A.

FIGS. 26A and 26B show a fourth embodiment of the present invention. A basic structure of the piston of the fourth embodiment is the same as that of the first embodiment. However, each of the protrusions 7 provided on the bottom surface 6*a* of the rectangular recessed portion 6 is formed not into a linear shape along the axis line Y of the pin boss portions 4*b* and 4*b*, but into an arc shape having bulged-shape (or a convex shape) formed by being curved outwards.

Therefore, this embodiment can also obtain the same working and effects as those of the other embodiments. Further, since each of the protrusions 7 is formed into the arc shape, a surface area of the protrusion 7 is slightly greater than that of the linear protrusion 7 of the first embodiment. Thus, the heat radiation effect of the crown portion 2 becomes greater.

Fifth Embodiment

Figure 27A:
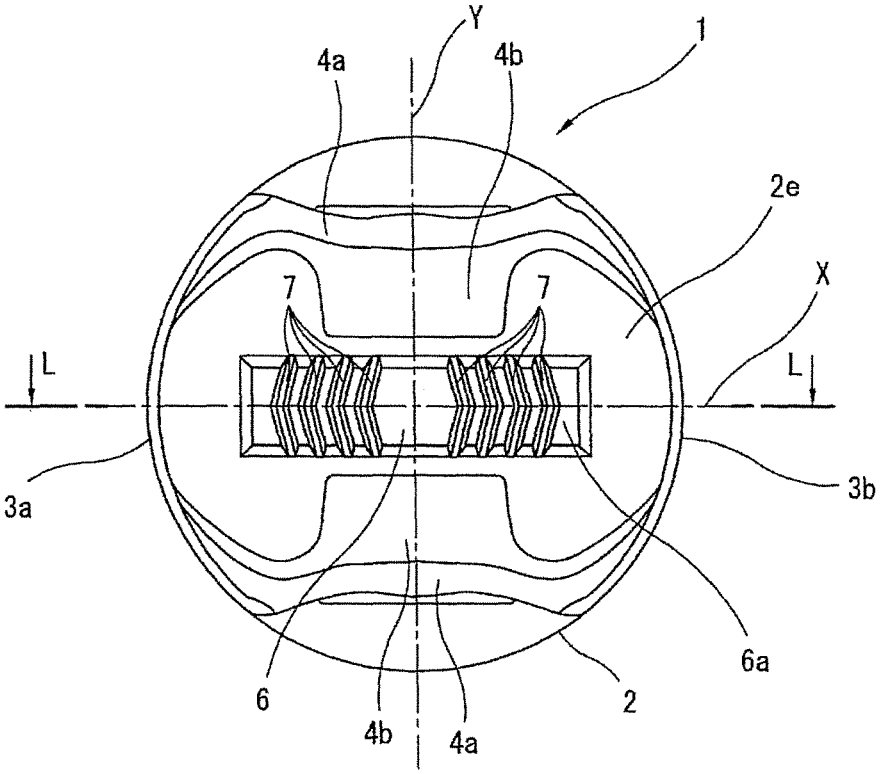
FIG. 27A is a bottom view of the piston.
Figure 27B:
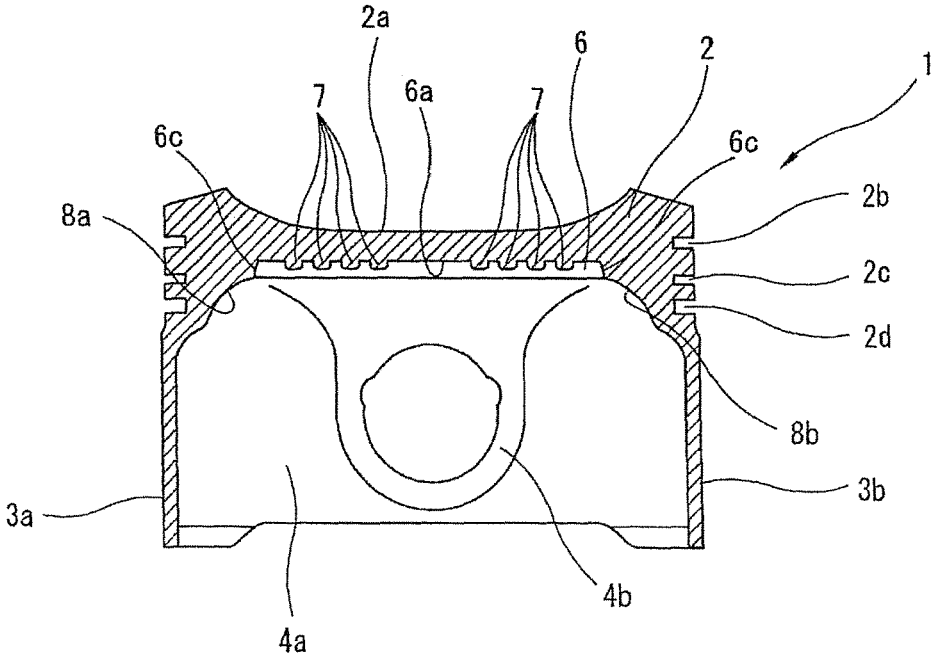
FIG. 27B is a longitudinal cross section taken along L-L line of FIG. 27A.

FIGS. 27A and 27B show a fifth embodiment of the present invention. A basic structure of the piston of the fourth embodiment is the same as that of the first embodiment. However, each of the protrusions 7 provided on the bottom surface 6*a* of the rectangular recessed portion 6 is formed not into a linear shape along the axis line Y of the pin boss portions 4*b* and 4*b*, but into an angle bracket shape and a reverse-angle bracket shape (or a chevron shape and a reverse-chevron shape) formed by being bent outwards.

Therefore, this embodiment can also obtain the same working and effects as those of the other embodiments. Further, since the protrusions 7 are formed into the angle bracket shape and the reverse-angle bracket shape, a surface area of the protrusion 7 is slightly greater than that of the linear protrusion 7 of the first embodiment. Thus, the heat radiation effect of the crown portion 2 becomes greater.

The present invention is not limited to the above embodiments. For instance, a shape of the protrusion 7 could be further changed, and the number of the protrusions 7 could be changed. In addition, a size or a depth of the recessed portion 6 could be arbitrarily set according to specifications of the piston.

Further, in the embodiments, the height of the protrusion is set to be lower than the depth of the recessed portion. However, the height of the protrusion could be set to be the substantially same as the depth of the recessed portion.

Technical ideas that can be understood from the embodiment described above will be explained below.

A distance between adjacent two protrusions among the plurality of protrusions could be set to be larger than that between the other adjacent two protrusions. According to this invention, by providing a portion where the distance between the adjacent two protrusions is larger, this portion can be used as a method of measuring a thickness of the crown portion.

Each of the plurality of protrusions could be formed into an arc shape. According to this invention, since each of the plurality of protrusions is formed into the arc shape, as compared with the linear protrusion, a surface area of the protrusion can be greater.

The arc-shaped protrusion might be formed into a bulged shape or a convex shape formed by being curved radially outwards. According to this invention, since the protrusion has the bulged shape or the convex shape formed by being curved radially outwards, a space is created in the middle of the curved protrusion. It is therefore possible to overlap a measurement point of a thickness of the crown portion at this space.

Each of the plurality of protrusions could be formed into a wedge shape. According to this invention, a surface area of the protrusion can be greater than the case where each of the plurality of protrusions is formed into the linear shape.

The plurality of protrusions could be formed into a bulged shape or a convex shape formed by being curved radially outwards. According to this invention, since a space is created in the middle of the curved protrusion, by this space, a thickness of the crown portion can be measured. That is, a top end of the protrusion can overlap a measurement point of the crown portion.

The plurality of protrusions could be formed into a grid pattern or a lattice pattern extending in an axial direction of the piston pin holes of the apron portions of the recessed portion and in a direction orthogonal to this axial direction.

The other cores except the center core could be cores that mold inner surfaces of the skirt portions and the apron portions.

The lower mold could be a mold that is separated by moving the other cores by a close distance in a space created after moving the center core down, in the process in which the piston is taken out from the cavity by separating the mold. By employing this mold-separating method, even if an undercut portion is present at the piston, the mold can be separated without a hitch. Further, since the protrusions are placed in the recessed portion, even if the other cores are moved together in a close direction, the other cores do not interfere with the protrusions.

The invention claimed is:

1. A piston for an internal combustion engine comprising:

a crown portion having a crown surface that defines a combustion chamber;

thrust-side and anti-thrust-side skirt portions formed integrally with the crown portion and configured to slide on a cylinder wall surface;

a pair of apron portions joined to the pair of skirt portions in a circumferential direction, each of the apron portions having a pin boss portion provided with a piston pin hole;

a recessed portion formed on a back surface that is an opposite side to the crown surface of the crown portion and extending between the pair of skirt portions along a substantially longitudinal direction;

a plurality of protrusions formed integrally with a bottom surface of the recessed portion and extending along an arrangement direction of the pair of apron portions or an arrangement direction of the pair of skirt portions;

a middle portion formed in the middle of the bottom surface of the recessed portion in a longitudinal direction of the bottom surface and having a predetermined span in the longitudinal direction of the bottom surface, wherein the middle portion divides the plurality of protrusions into two groups, and the predetermined span is greater than a predetermined clearance between two adjacent protrusions in each group of the two groups, the middle portion defining the predetermined span; and at least one end edge in a longitudinal direction of each of the protrusions being integrally connected to an inner side surface of the recessed portion, the inner side surface facing the at least one end edge.

2. The piston for the internal combustion engine as claimed in claim 1, wherein:

a height of each of the protrusions is set to be the same as or lower than a depth of the recessed portion.

3. The piston for the internal combustion engine as claimed in claim 2, wherein:

the recessed portion is formed into a rectangular elongated groove that extends lengthwise along a direction between the pair of skirt portions.

4. The piston for the internal combustion engine as claimed in claim 1, wherein:

the plurality of protrusions are formed along an axial direction of the piston pin holes of the apron portions.

5. The piston for the internal combustion engine as claimed in claim 4, wherein:

a distance between two predetermined adjacent protrusions of the plurality of protrusions is set to be larger than that between two other adjacent protrusions of the plurality of protrusions.

6. The piston for the internal combustion engine as claimed in claim 1, wherein:

each of the plurality of protrusions is formed into an arc shape.

7. The piston for the internal combustion engine as claimed in claim 6, wherein:

the arc-shaped protrusion is formed into a convex shape curved radially outwards.

8. The piston for the internal combustion engine as claimed in claim 1, wherein:

each of the plurality of protrusions is formed into a wedge shape.

9. The piston for the internal combustion engine as claimed in claim 8, wherein:

each of the plurality of protrusions is formed into a convex shape curved radially outwards.

10. The piston for the internal combustion engine as claimed in claim 1, wherein:

the plurality of protrusions are formed into a grid pattern that extends in an axial direction of the piston pin holes of the apron portions of the recessed portion and in a direction orthogonal to the axial direction of the piston pin holes.

11. The piston of claim 1, wherein a length of the predetermined span is from one end of the middle portion to another end of the middle portion.

12. The piston of claim 1, wherein the middle portion is free of the plurality of protrusions.

13. A production device for a piston for an internal combustion engine, the piston having a crown portion having a crown surface that defines a combustion chamber, thrust-side and anti-thrust-side skirt portions formed integrally with the crown portion and sliding on a cylinder wall surface and a pair of apron portions joined to the pair of skirt portions in a circumferential direction, each of the apron portions having a pin boss portion provided with a piston pin hole, the production device comprising: a lower mold that molds inner surfaces of the both skirt portions and the both apron portions and a back surface that is an opposite side to the crown surface of the crown portion, molds a recessed portion on the back surface between the pair of skirt portions and molds a plurality of protrusions integrally with an inner surface of the recessed portion, the plurality of protrusions being formed along an arrangement direction of the pair of skirt portions or an arrangement direction of the pair of apron portions, wherein a middle portion is formed in a middle of a bottom surface of the recessed portion in a longitudinal direction of the bottom surface of the recessed portion, and has a predetermined span in the longitudinal direction of the bottom surface, the middle portion dividing the plurality of protrusions into two groups, the predetermined span being greater than a predetermined clearance between two adjacent protrusions in each group of the two groups, the middle portion defining the predetermined span, and at least one end edge in a longitudinal direction of each of the protrusions being integrally connected to an inner side surface of the recessed portion, the inner side surface facing the at least one end edge; and an upper mold that is located on an upper side of the lower mold and molds a crown surface side of the crown portion, and the lower mold being provided with: a protruding portion for molding the recessed portion, the protruding portion being formed on an upper surface of a middle portion of an inner surface forming portion that forms each surface of the both skirt portions; and a plurality of groove portions for molding the protrusions, the plurality of groove portions being formed on an upper surface of the protruding portion, and the lower mold being configured so that a height of the middle portion is set to be higher than those of the other portions of the inner surface forming portion of the lower mold by a height of the protruding portion, and a depth of each of the groove portions is set to be shallower than the height of the protruding portion, a height of an opening formed on at least one end side in a longitudinal direction of each of the groove portions is set to be lower than or the substantially same as a bottom surface of the groove portion, and molten metal poured in the lower mold flows to the bottom surface of each of the groove portions from the opening of the groove portion.

14. The production device for the piston for the internal combustion engine as claimed in claim 13, wherein: the lower mold has a first core in which the protruding portion, the groove portions and the openings are provided and a second core which is located at an outer peripheral side of the first core and forms the inner surfaces of the both skirt portions and the both apron portions.

15. The production device for the piston for the internal combustion engine as claimed in claim 14, wherein: a height of the bottom surface of each of the groove portions of the first core after clamping the lower mold is set to be higher than a height in a vertical direction of the second core.

16. A method of producing a piston for an internal combustion engine, the piston having a crown portion having a crown surface that defines a combustion chamber; thrust-side and anti-thrust-side skirt portions formed integrally with the crown portion and sliding on a cylinder wall surface; a pair of apron portions joined to the pair of skirt portions in a circumferential direction, each of the apron portions having a pin boss portion provided with a piston pin hole; a recessed portion formed on a back surface that is an opposite side to the crown surface of the crown portion and extending between the pair of skirt portions along a substantially longitudinal direction; and a plurality of protrusions formed integrally with a bottom surface of the recessed portion and extending along an arrangement direction of the pair of apron portions, and at least one end edge in a longitudinal direction of each of the protrusions integrally connected to an inner side of the recessed portion, the inner side surface facing the at least one end edge, wherein a middle portion is formed in a middle of the bottom surface of the recessed portion in a longitudinal direction of the bottom surface of the recessed portion, and has a predetermined span in the longitudinal direction of the bottom surface of the recessed portion, the middle portion dividing the plurality of protrusions into two groups, the predetermined span being greater than a predetermined clearance between two adjacent protrusions in each group of the two groups, the middle portion defining the predetermined span, the method comprising: a clamping process clamping a lower mold that molds a back surface that is an opposite side to the crown surface of the crown portion and inner surfaces of the both skirt portions and the both apron portions, and setting an upper mold that molds the crown surface of the crown portion to a predetermined upper position of the lower mold; a pouring process pouring molten metal into a cavity formed between the lower mold and the upper mold by a gravity casting process; a flowing process, during the pouring process, making the molten metal flow to a bottom surface of each of a plurality of groove portions of the lower mold, which mold the plurality of protrusions, through an opening formed at one end portion of each of the groove portions; and a taking-out process, after filling the cavity with the molten metal and cooling and solidifying the molten metal, separating the upper mold and the lower mold and taking out the piston from the cavity.

17. The method of producing the piston for the internal combustion engine as claimed in claim 16, wherein: the lower mold is formed from a plurality of divided cores, a height of a center core of the plurality of divided cores, which has a protruding portion for molding the recessed portion on an upper surface of the center core, after clamping the lower mold is set to be higher than the other cores by at least a height of the protruding portion, and in the flowing process, the molten metal gradually rising toward an upper surface side of the center core flows into each of the groove portions from the bottom surface side of the groove portion through the opening of the groove portion.

18. The method of producing the piston for the internal combustion engine as claimed in claim 17, wherein: the upper surface, on which the protruding portion is formed, of the center core after the clamping of the lower mold is set to a higher position than heights of the other cores, and in the flowing process, the molten metal flows to the bottom surface of the groove portion from the other upper surface sides through the opening of the groove portion.

19. The method of producing the piston for the internal combustion engine as claimed in claim 17, wherein: the other cores except the center core mold the inner surfaces of the both skirt portions and the both apron portions.

20. The method of producing the piston for the internal combustion engine as claimed in claim 17, wherein: in the taking-out process separating the upper mold and the lower mold and taking out the piston from the cavity, the lower mold is separated by moving the other cores by a close distance in a space created after moving the center core down.

* * * * *